US010961088B2

(12) United States Patent
Norz

(10) Patent No.: US 10,961,088 B2
(45) Date of Patent: Mar. 30, 2021

(54) FOLDING SUSPENDED BALLAST GUIDE FOR A CRANE AND CRANE HAVING A FOLDING SUSPENDED BALLAST GUIDE

(71) Applicant: Liebherr-Werk Ehingen GmbH, Ehingen/Donau (DE)

(72) Inventor: Clemens Norz, Ehingen (DE)

(73) Assignee: Liebherr-Werk Ehingen GmbH, Ehingen/Donau (DE)

( * ) Notice: Subject to any disclaimer, the term of this patent is extended or adjusted under 35 U.S.C. 154(b) by 0 days.

(21) Appl. No.: 16/261,706

(22) Filed: Jan. 30, 2019

(65) Prior Publication Data

US 2019/0233261 A1 Aug. 1, 2019

(30) Foreign Application Priority Data

Jan. 30, 2018 (DE) ..... 10 2018 102 025.2

(51) Int. Cl.
*B66C 23/76* (2006.01)

(52) U.S. Cl.
CPC ..... *B66C 23/76* (2013.01)

(58) Field of Classification Search
CPC ..... B66C 23/72; B66C 23/74; B66C 23/76; B66C 23/82; E02F 9/18; B62D 49/085; B66F 9/07554
See application file for complete search history.

(56) References Cited

U.S. PATENT DOCUMENTS

| | | | | |
|---|---|---|---|---|
| 4,729,486 | A † | 3/1988 | Petzold | |
| 5,035,337 | A * | 7/1991 | Juergens | B66C 23/36 212/195 |
| 5,586,667 | A * | 12/1996 | Landry | B66C 23/76 212/195 |
| 7,762,412 | B2 * | 7/2010 | Porubcansky | B66C 23/76 212/237 |
| 7,967,158 | B2 † | 6/2011 | Pech | |
| 10,183,848 | B2 † | 1/2019 | Albinger | |
| 2019/0084811 | A1 † | 3/2019 | Hamaguchi | |
| 2020/0262687 | A1 * | 8/2020 | Norz | B66C 23/76 |

FOREIGN PATENT DOCUMENTS

EP 2597066 A1 5/2013

OTHER PUBLICATIONS

Liebherr Up Load, Jan. 1, 2018.†
Facebook Photos, hadel.net operated by Jens Hadel and Andreas Keil to post their photos of cranes and other items; Jul. 28, 2017.†

* cited by examiner
† cited by third party

*Primary Examiner* — Sang K Kim
*Assistant Examiner* — Nathaniel L Adams
(74) *Attorney, Agent, or Firm* — Dilworth & Barrese, LLP

(57) ABSTRACT

The invention relates to a folding suspended ballast guide for a crane having suspended ballast comprising two lattice pieces pivotably connected to one another, wherein in an inwardly pivoted position of the lattice pieces, one of the lattice pieces is at least partially arrangeable in the other lattice piece. The invention is further directed to a crane having a corresponding suspended ballast guide.

10 Claims, 5 Drawing Sheets

Figure 1A:
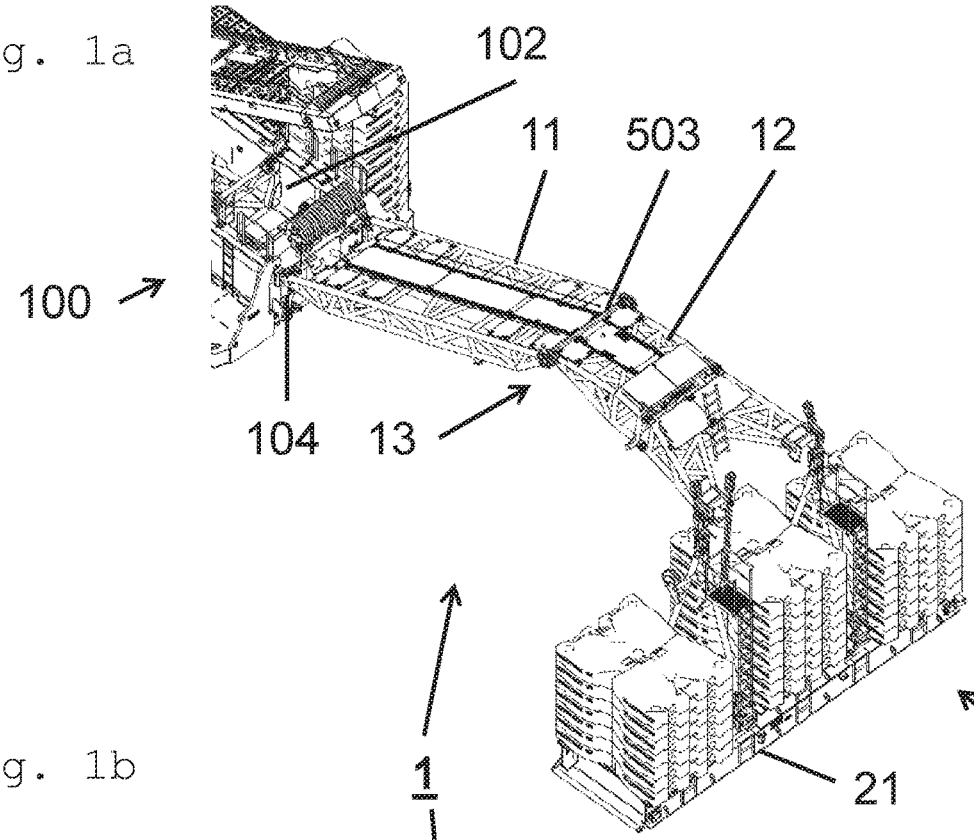

FOLDING SUSPENDED BALLAST GUIDE FOR A CRANE AND CRANE HAVING A FOLDING SUSPENDED BALLAST GUIDE

BACKGROUND OF THE INVENTION

The invention relates to a folding suspended ballast guide for a crane having suspended ballast comprising two lattice pieces pivotably connected to one another, wherein in an inwardly pivoted position of the lattice pieces, one of the lattice pieces is at least partially arrangeable in the other lattice piece. The invention is further directed to a crane having a corresponding suspended ballast guide.

With folding suspended ballast guides in accordance with the category, it is known to pivotably couple two lattice pieces or other part sections with one another such that suspended ballast held by the suspended ballast guide can be held at different distances from the crane in dependence on the pivot angle of the lattice pieces and such that different ballast torques can thereby be introduced into the crane.

It is problematic with the suspended ballast guides known from the prior art that they only have a limited pivot angle and the suspended ballast radii and ballast torques that can be set by means of them are thus likewise limited to a restricted range. It can hereby occur that a required ballast torque cannot be achieved by means of a ballast weight placed on and that a laborious and time-consuming reballasting therefore becomes necessary.

SUMMARY OF THE INVENTION

It is therefore the object of the invention to provide an improved suspended ballast guide by means of which an adjustment range is possible that is as large as possible. This object is achieved in accordance with the invention by a folding suspended ballast guide having the features herein. Advantageous embodiments are also the subject herein.

A folding suspended ballast guide for a crane having suspended ballast is accordingly provided. The suspended ballast guide comprises two lattice pieces pivotably connected to one another, wherein in an inwardly pivoted position of the lattice pieces, one of the lattice pieces is at least partially arrangeable in the other lattice piece The term of the inwardly pivoted position designates a position here in which the lattice piece are inwardly pivoted toward one another to a maximum, that is, in which they span a minimal angle with respect to one another. The term of the inwardly pivoted position can furthermore comprise positions of the lattice pieces adjacent thereto in which they are almost completely inwardly pivoted or are arranged less in one another than in the completely inwardly pivoted position. The angle spanned by the lattice pieces is here correspondingly larger than in the completely inwardly pivoted position.

The lattice pieces can be configured such that they are arranged in one another in the inwardly pivoted position while this is not the case in an outwardly pivoted position of the lattice pieces. A cutout can be provided at one of the lattice pieces for this purpose and the other lattice piece can be arranged in it in the inwardly pivoted position.

The ballast radius can be set as smaller than in accordance with the prior art in the completely inwardly pivoted position or in the positions of the lattice pieces adjacent thereto due to the corresponding design of the lattice pieces. The adjustment range of the suspended ballast guide is hereby increased and a very large ballast torque and a correspondingly very small ballast torque can be achieved with little ballast mass in dependence on the pivot position of the lattice pieces.

It is accordingly advantageously also less frequently necessary to remove ballast plates from a ballast carrier plate. It is furthermore possible by means of the suspended ballast guide in accordance with the invention to reduce the ballast torque by a correspondingly very large amount with small loads hoisted by the crane without having to reballast the ballast weight for this purpose.

It is conceivable in a preferred embodiment of the invention that at least one of the lattice pieces has a C-shaped cross-section, with the other one of the lattice pieces being at least partially arranged between the limbs of the C-shaped cross-section in the inwardly pivoted position of the lattice pieces. Since suspended ballast guides of the category typically have an elongate construction shape, a cross-section extending perpendicular to the longitudinal direction of the respective lattice piece is meant by the cross-section.

It is conceivable in a further preferred embodiment that at least one of the lattice pieces is designed with an open profile. The term of the open profile has the meaning here that the respective lattice piece has a cut-out which extends at least partially in the longitudinal direction and in which the respective other lattice piece is at least partially arrangeable in the inwardly pivoted position.

It is furthermore conceivable in a further preferred embodiment that at least one overhung pin is provided to couple the suspended ballast guide to a derrick guying of the crane.

The overhung pin can rotate freely about the components coupled to it and the occurrence of constraining forces between the components can thus be avoided. The pin can here be understood as part of the suspended ballast guide. Exactly two corresponding pins can also be provided that are arranged to the left and to the right of the longitudinal axis of the suspended ballast guide, in particular symmetrically with one another.

It is conceivable in a particularly preferred embodiment of the invention that the at least one pin is arranged further away from the longitudinal axis of the suspended ballast guide than the laterally outermost region of the lattice pieces. The pin can in this manner, in particular in an inwardly pivoted position of the suspended ballast guide, be the laterally outermost regions of the suspended ballast guide. It can hereby be avoided that the derrick guying that is coupled to the suspended ballast guide via the pin collides with parts of the suspended ballast guide on the pivoting thereof.

It is conceivable in a further particularly preferred embodiment that the at least one pin is arranged at a widened section of one of the lattice pieces that is wider than other sections of the same lattice piece. The corresponding lattice piece can accordingly have a tapering cross-section, with the pin being arrangeable at a wider point or at the widest point of the respective lattice piece.

It is conceivable in a further preferred embodiment of the invention that the lattice pieces are designed as separable for transport purposes. The lattice pieces of the suspended ballast guide can accordingly be separated from one another, whereby their transport can be made simpler. It is also conceivable to design the lattice pieces themselves in a dismountable manner and thus to make the dismounted lattice pieces even easier to transport.

It is conceivable in a further preferred embodiment that a continuous axle is provided for coupling the lattice pieces to one another. The axle can here couple at least two regions of the lattice pieces with one another that are spaced apart from one another. The axle can be led continuously from a left side to a right side of the lattice pieces. Alternatively, two overhung pins can be provided to couple the lattice pieces to one another.

The invention is further directed to a crane having at least one folding suspended ballast guide in accordance with the description herein.

BRIEF DESCRIPTON OF THE DRAWINGS

Figure 1B:
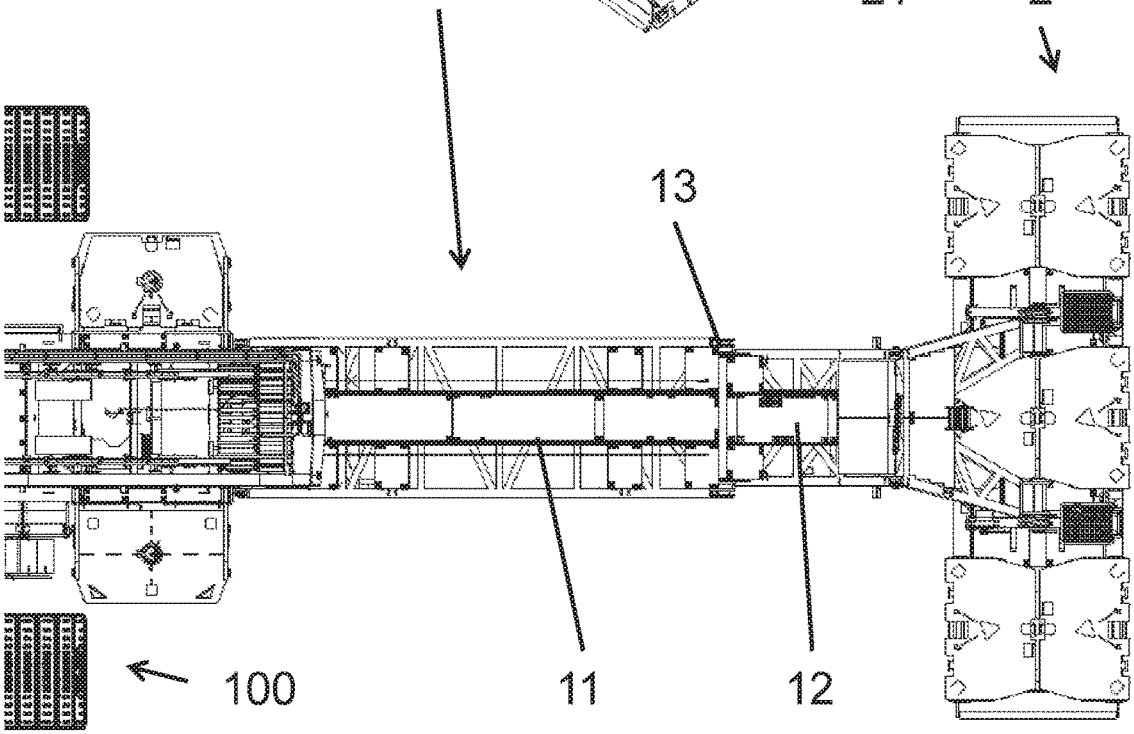
Figure 2A:
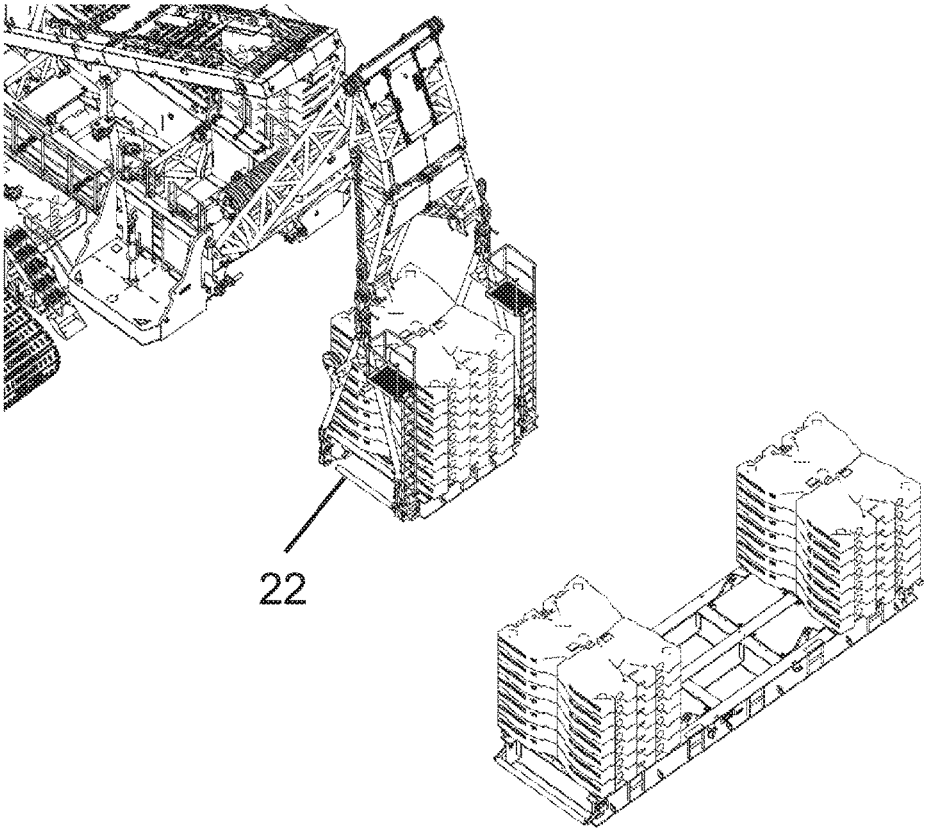
Figure 2B:
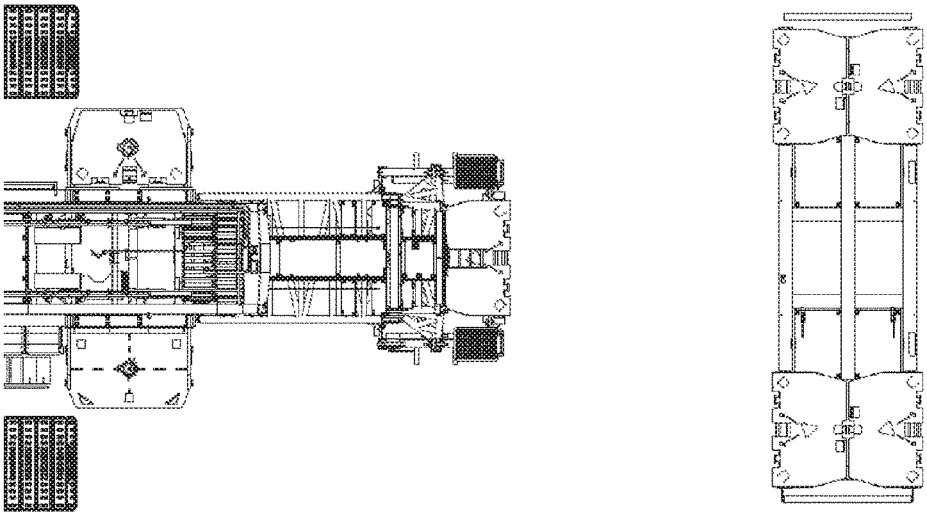
Figure 3:
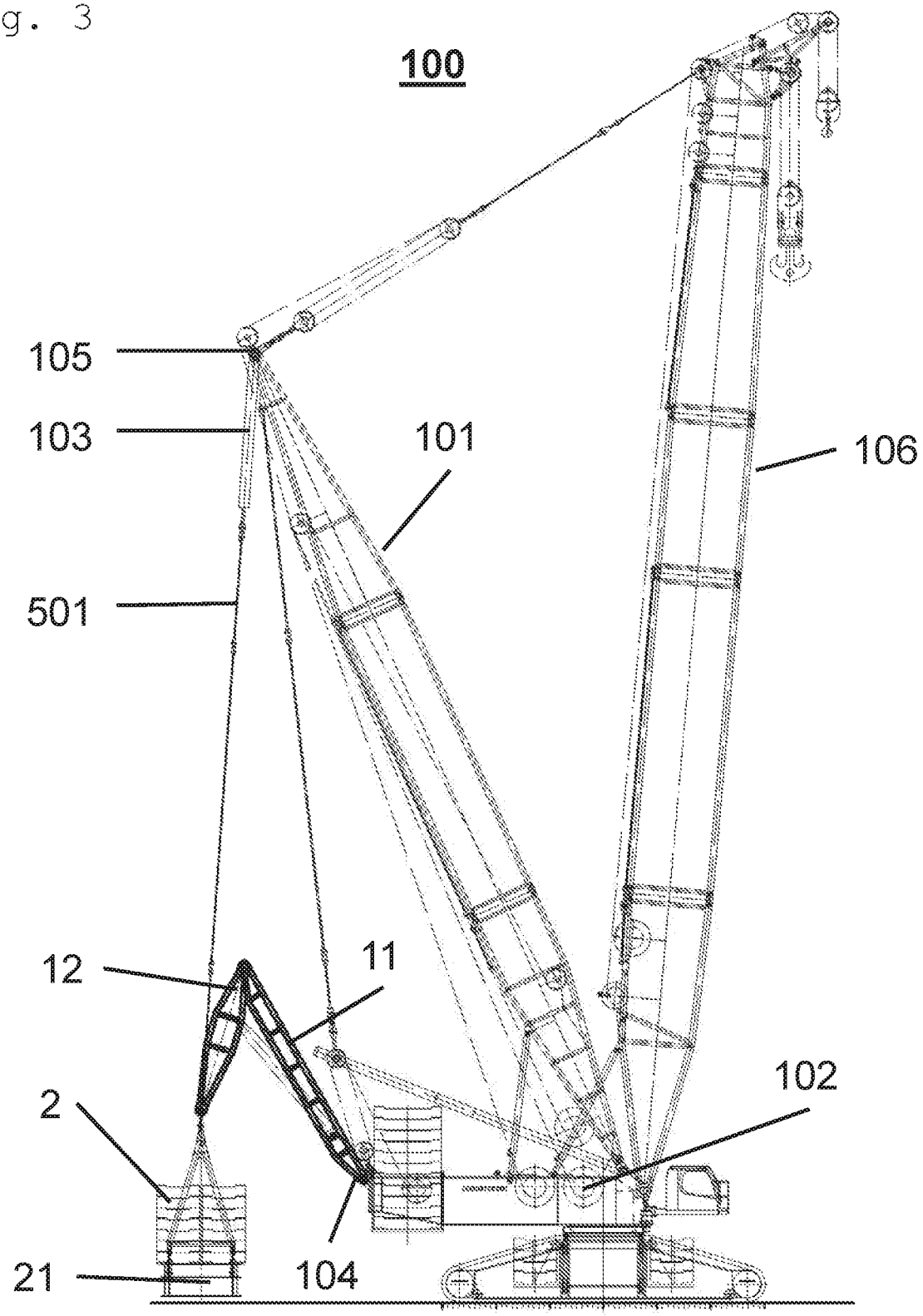
Figure 4:
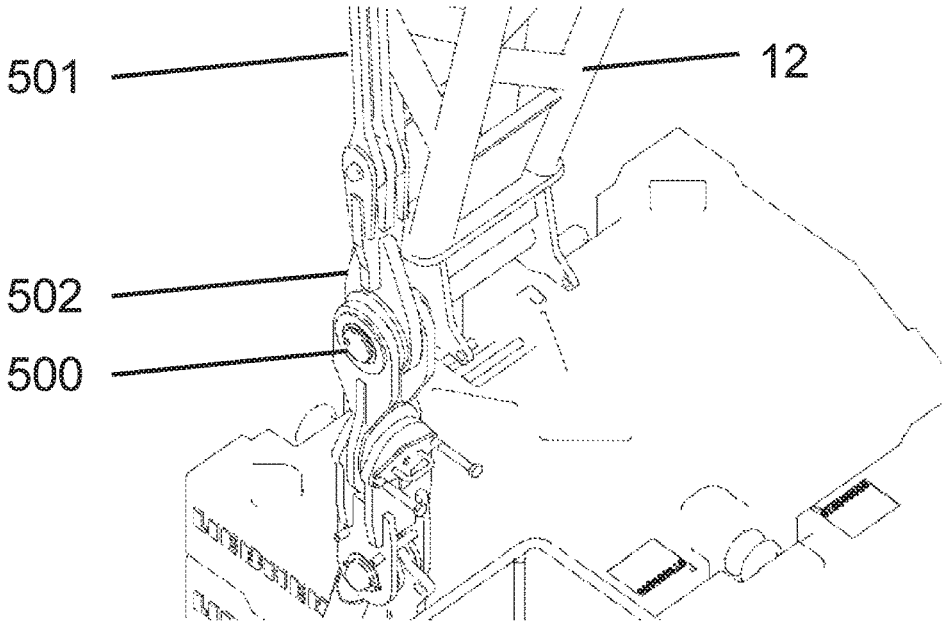
Figure 5:
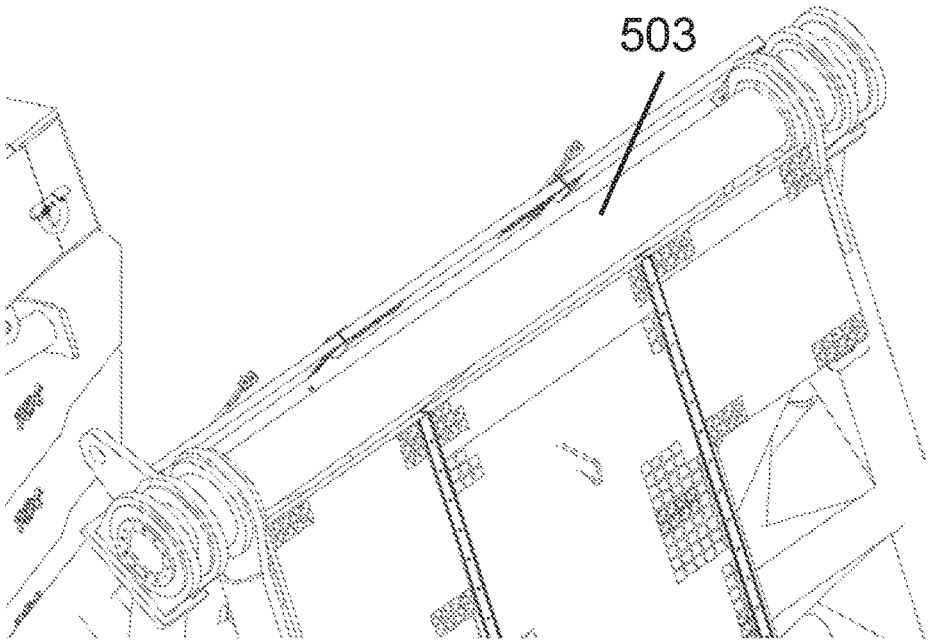
Figure 6:
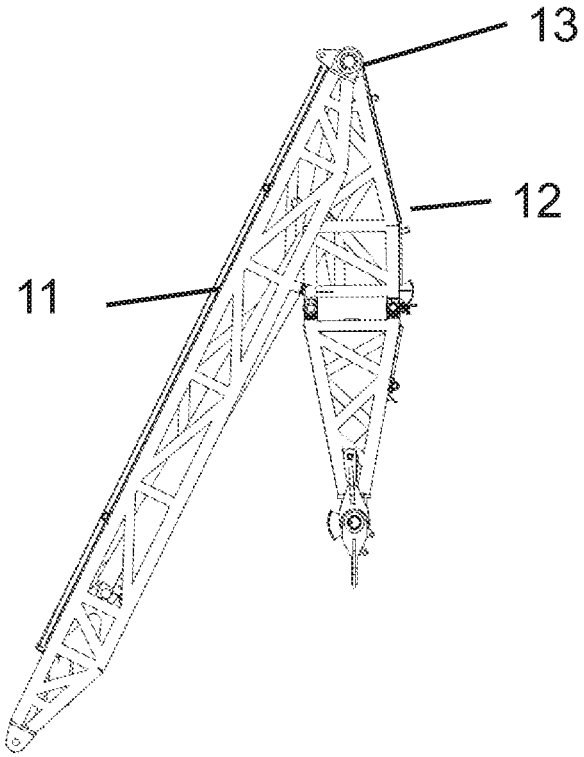
Figure 7:
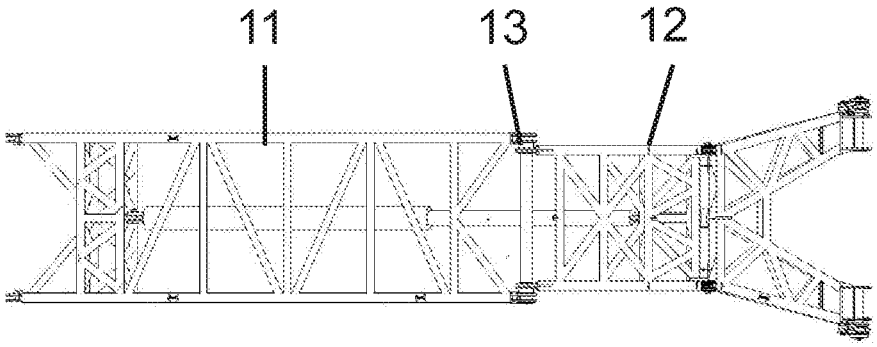

Further details and advantages of the invention are explained with reference to the embodiment shown by way of example in the Figures. There are shown:

FIG. 1*a*: a folding suspended ballast guide in a perspective view;

FIG. 1*b*: a folding suspended ballast guide in a plan view;

FIG. 2*a*: a folding suspended ballast guide in a partially inwardly pivoted position in a perspective view;

FIG. 2*b*: a folding suspended ballast guide in a partially inwardly pivoted position in a plan view;

FIG. 3: a crane in accordance with the invention with a folding suspended ballast guide;

FIG. 4: a detailed view of the folding suspended ballast guide with ballast and an overhung pin;

FIG. 5: a detailed view of the folding suspended ballast guide with a continuous axle for coupling the two lattice pieces;

FIG. 6: a folding suspended ballast guide in an inwardly pivoted position and overlapping lattice pieces; and FIG. 7: a folding suspended ballast guide in an elongated position and in a plan view.

DESCRIPTION OF THE PREFERRED EMBODIMENTS

FIG. 1*a* shows a folding suspended ballast guide 1 in accordance with the invention for a crane 100 having suspended ballast 2 shown at the right in the Figure. The suspended ballast guide 1 comprises at least two lattice pieces 11, 12 pivotably connected to one another. It is not relevant to the invention whether the lattice piece 11 arranged closer to the crane 100 is arrangeable in the lattice piece 12 spaced further apart therefrom or vice versa.

FIGS. 1*a* and 1*b* show the suspended ballast guide 1 in an outwardly pivoted or elongated or almost elongated state in which the lattice pieces 11, 12 are not supported in one another or in which the lattice pieces 11, 12 are only arranged overlapping with one another in the region of an axle 503 that is also shown in FIG. 5.

The crane comprises a slewing platform 102 at which the suspended ballast guide 1 is pivotably arranged. An axle can be provided at a pivot point 104 for this purpose, the axle in particular being arranged horizontally and being pivotably coupled to one of the lattice pieces 11, 12.

The axle or pivot axle 503 shown in FIG. 5 is arranged in the suspended ballast guide 1 in the pivot region marked by reference numeral 13 in FIGS. 1*a* and 1*b*.

The suspended ballast 2 can comprise a suspended ballast pallet 21 on which corresponding suspended ballast weights can be arranged. The suspended ballast pallet 21 can comprise a vario pallet 22 such as is shown in FIG. 2*a*.

The lattice pieces 11, 12 of the suspended ballast guide 1 can be arranged receivable and offset in one another in a joint in the pivot region 13 and can thus be pivoted in a larger pivot angle range relative to one another. A large adjustment range can therefore effect approximately a doubling of the ballast torque that can be exerted on the crane 100 by the ballast 2.

A flexible ballast utilization is thus made possible without reballasting in accordance with the invention. Smaller torques can also be introduced into the crane 100 with the same ballast mass than is known from the prior art due to the increased adjustment range of the suspended ballast guide 1.

The suspended ballast guide 1 in accordance with the invention is also adjustable under a maximum load, that is, under a maximum ballast lying on the suspended pallet 21.

The ballast 2 guided by means of the suspended ballast guide 1 in accordance with the invention is defined in its position and is secured against a swinging to and fro to the right and to the left. Only a movement upward and downward would be possible without a holder. As already indicated and as can be seen from FIGS. 2*a* and 2*b*, a radius adjustment is also possible in operation with vario pallets 22, with no reballasting being required. The small vario pallet 22 can be released from the suspended load pallet 21. The folding in of the suspended ballast guide 1 can take place subsequently so that the crane 100 with the vario pallet 22 is freely rotatable about the axis of rotation of the slewing platform 102.

As can be seen from FIG. 3, a permanent ground proximity of the suspended load 2 can take place by adjustment of traction cylinders 103 at the head 105 of the derrick boom 101 for security against a backward tilting in the case of a load snapping. FIG. 3 here shows the arrangement of the tension cylinders 103 at the head of the derrick boom 101. The pivot bearing of the total suspended ballast guide 1 can be freely pivotable about a horizontal axis at the pivot point 104 of the suspended ballast guide 1 at the slewing platform 102.

The ballast radius of the suspended ballast guide 1 is continuously selectable. It is conceivable to provide sensors for a position determination of the ballast 2 via angle transmitters, for example in the two lattice pieces 11, 12.

The ballast radius can be continuously adjustable at an unchanging speed, with the adjustment being able to take place independently of the geometrical change. This can be ensured by a control of the crane 100.

One or more adjustment cylinders for adjusting the lattice pieces 11, 12 can be provided in the region of the lattice pieces 11, 12. A transformation of the cylinder stroke to the adjustment region can be provided. Shorter cylinders can thus also be sufficient for a complete pivoting of the lattice pieces 11, 12. The ballast radius can, for example, be variable by 10 m by means of cylinders having a 4 m cylinder stroke. The kink length is hereby reduced and a lighter construction shape is promoted. With larger units, two or more adjustment cylinders can also be provided to adjust the lattice pieces 11, 12.

The position of the derrick head 105 can remain unchanged over the total adjustment range of the suspended ballast guide 1. A change of the derrick radius, in particular in the guided suspended ballast, changes the main boom position via the S guying that is led from the derrick boom 101 to the main boom 106. The change of the derrick radius here changes the position of the load in an unwanted manner. It is conceivable here to track the corresponding winches to thus compensate a change of the derrick radius.

It is furthermore possible to ensure or fix the ballast radius, for example, in the event of unevenness of the crane installation site. Assuming the crane 100 tilts slightly to the front under load because, for example, the ground yields, the radius of the load increases and generates a greater tilt torque on the crane 100. The radius of a non-guided suspended ballast is reduced by the tilt of the crane 100. Both effects are superposed and can result in a tilting of the crane 100. The ballast radius is kept constant by the suspended ballast guide in accordance with the invention.

To counteract the outward pivoting of the load, a regulation/control of the crane can be configured to adapt the radius of the suspended ballast 2 by a corresponding adjustment of the suspended ballast guide 1 in dependence on a tilt behavior of the crane 100 such that no excessive tilt torque acts on the crane 100.

As already described, one or both of the lattice pieces 11, 12 can be designed as an open profile. This is indicated in FIGS. 1*a* and 2*a*, for example. The suspended ballast guide 1 is hereby torsionally flexible. The ballast 2 can be placed down even if the ground slopes. Twisting of the ballast pallet 21 with respect to the crane 100 can be compensated by the torsionally flexible suspended ballast guide 1.

FIG. 4 shows that the derrick guying 501 via overhung pins 500 can in particular be led past the sides of the lattice pieces 11, 12 of the suspended ballast guide 1. Constraining forces within the guide can hereby be avoided. A tab 502 can rotate freely and does not impact elements of the lattice piece 11, 12.

To avoid collisions between parts of the slewing platform 102 and the suspended ballast guide 1, the derrick guying 501 is correspondingly long. This could occur with excessive retraction of the torsion cylinders.

FIG. 6 shows the folding suspended ballast guide 1 in the inwardly pivoted position. It can be clearly recognized that one of the lattice pieces 11, 12 overlaps the other here and is at least partly arranged in it.

FIG. 7 shows the folding suspended ballast guide in an elongated position and in a plan view. The overlap of significant sections of the two lattice pieces 11, 12 is canceled. A residual overlap of the sections of the lattice pieces 11, 12 adjacent to the pivot axle 503 only takes place in the pivot region 13.

The invention claimed is:

1. A folding suspended ballast guide (1) for a crane (100) having suspended ballast (2), and comprising two lattice pieces (11, 12) directly pivotably connected to one another about a pivot axle (503), wherein in an inwardly pivoted position of the lattice pieces (11, 12), one of the lattice pieces (12) is at least partially arranged within the other lattice piece (11), and in an elongated position, the lattice pieces (11, 12) only overlap one another in a region (13) of the axle (503), wherein one (11) of said two lattice pieces (11, 12) is arranged to be pivotally mounted (104) upon a slewing platform (102) and the other (12) of said two lattice pieces (11, 12) is arranged to suspend the ballast (2) therefrom, and upon inward pivoting, the lattice piece (12) arranged to suspend the ballast (2) is at least partially arranged within the lattice piece (11) arranged to be pivotally mounted (104) upon the slewing platform (102).

2. A folding suspended ballast guide (1) in accordance with claim 1, wherein at least one of the lattice pieces (11, 12) has a C-shaped cross-section, with the other one of the lattice pieces (11, 12) being arranged at least partially between the limbs of the C-shaped cross-section in the inwardly pivoted position of the lattice pieces (11, 12).

3. A folding suspended ballast guide (1) in accordance with claim 1, wherein at least one of the lattice pieces (11, 12) is designed with an open profile.

4. A folding suspended ballast guide (1) in accordance with claim 1, wherein at least one overhung pin (500) is provided for coupling the suspended ballast guide (1) to a derrick guying (501) of the crane (100).

5. A folding suspended ballast guide (1) in accordance with claim 4, wherein the at least one pin (500) is arranged further away from the longitudinal axis of the suspended ballast guide (1) than the laterally outermost regions of the lattice pieces (11, 12).

6. A folding suspended ballast guide (1) in accordance with claim 4, wherein the at least one pin (500) is arranged at a widened section of one of the lattice pieces (11, 12) that is wider than other sections of the same lattice piece (11, 12).

7. A folding suspended ballast guide (1) in accordance with claim 1, wherein the lattice pieces (11, 12) are designed as separable for transport purposes.

8. A folding suspended ballast guide (1) in accordance with claim 1, wherein a continuous axle (503) is provided for a coupling of the lattice pieces (11, 12) to one another.

9. A folding suspended ballast guide (1) in accordance with claim 1, wherein two overhung pins are provided for the coupling of the lattice pieces (11, 12) to one another.

10. A crane (100) having at least one folding suspended ballast guide (1) in accordance with claim 1.

* * * * *